US005400233A

United States Patent [19]

Hong

[11] Patent Number: 5,400,233

[45] Date of Patent: Mar. 21, 1995

[54] MODULAR ANGULAR/CURVATURE ILLUMINATION ASSEMBLY

[76] Inventor: Richard Hong, 11576 49'er Cir., Gold River, Calif. 95670

[21] Appl. No.: 88,856

[22] Filed: Jul. 7, 1993

[51] Int. Cl.[6] ..... F21V 21/00

[52] U.S. Cl. ..... 362/382; 362/249; 362/404

[58] Field of Search ..... 362/249, 147, 362, 404, 362/457, 458, 382, 217, 219

[56] References Cited

U.S. PATENT DOCUMENTS 4,053,761 10/1977 Brinkley ..... 362/404 X
4,731,710 3/1988 Distasio ..... 362/404 X
4,980,808 12/1990 Lilos ..... 362/404 X

*Primary Examiner*—Stephen F. Husar
*Attorney, Agent, or Firm*—Baker & Daniels

[57] ABSTRACT

A modular angular/curvature illumination assembly includes a plurality of channel units each of which has two opposite side walls gradually shaped by a step-by-step rolling process, during which a metal plate is moved through a series of roller die sets for rolling treatment. The die sets apply varying amount of pressure on the plate. A light unit is mounted on one of the channel units. A plurality of coupling units interconnect the channel units in such a manner that the side walls of any adjacent pair of the channel units are coupled together by means of one of the coupling units.

3 Claims, 6 Drawing Sheets

MODULAR ANGULAR/CURVATURE ILLUMINATION ASSEMBLY

BACKGROUND OF THE INVENTION

1. Field of the Invention

This invention relates to an illumination assembly, more particularly to a modular angular/curvature illumination assembly whose outer appearance can vary within a wide range.

2. Description of the Related Art

In the related art, a wall/ceiling light is mounted on a decorative casing which is secured to a wall. Referring to FIGS. 1 through 6, one or two light units (indicated by the phantom lines) are mounted on a casing 1, 2, 3 in a known manner. The casing 1, 2, 3 is formed from a metal plate by means of a folding machine, and has a simple design. Such a casing is limited in design of shape. Referring to FIG. 7 which shows a conventional illumination assembly with three light units, a plate can be formed into a stepped casing 4 of a complicated shape by use of a press for aesthetic purposes. In this case, however, an expensive die set is needed. Furthermore, if the length of the casing 4 is more than 30 inches, no bulky press can be provided to form the same from a metal plate in this art. The above-mentioned casings 4 also suffer from the following drawbacks:

(1) The angle between two interconnected planar plates must be more than 90 degrees. In other words, obtuse angles are allowed, e.g. the angle A1 of FIG. 8, and acute angles are impossible, e.g. the angle A2 of FIG. 9. Furthermore, the two interconnected and curved plates 5 of FIG. 10 cannot be formed by a press.

(2) Only one color can be electroplated on the casing 4.

SUMMARY OF THE INVENTION

An object of this invention is to provide a modular angular/curvature illumination assembly whose outer appearance can vary within a wide range.

According to this invention, a modular angular/curvature illumination assembly includes a plurality of channel units each of which has two opposite side walls gradually shaped by a step-by-step rolling process, during which a metal plate is moved through a series of roller die sets for rolling treatment. The die sets apply varying amount of pressure on the plate. A plurality of coupling units interconnect the channel units in such a manner that the side walls of any adjacent pair of the channel units are coupled together by one of the coupling units. A light unit is mounted on one of the channel units. Because the channel units may have different shapes or colors, the wall plate assembly can be of various outer appearances. Furthermore, the step-by-step rolling processes enable the angle between any adjacent plates of any of the channel units to be less than 90 degrees.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
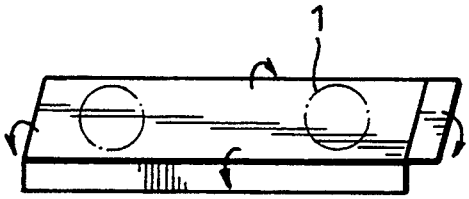
FIG.1 PRIOR ART
FIGS. 1 to 6 illustrate the manufacture of three types of conventional illumination assemblies which are formed by use of a folding machine.
Figure 2:
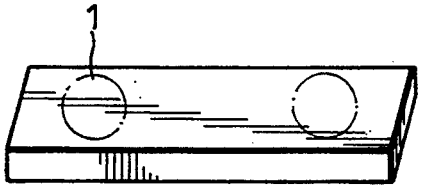
FIG.2 PRIOR ART
Figure 3:
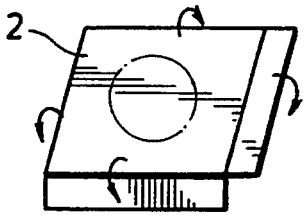
FIG.3 PRIOR ART
Figure 4:
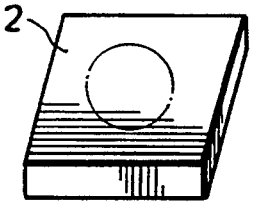
FIG.4 PRIOR ART
Figure 5:
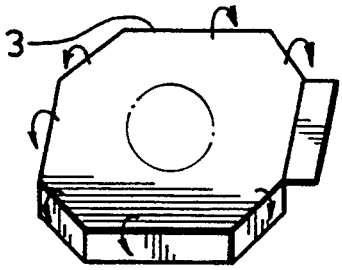
FIG.5 PRIOR ART
Figure 6:
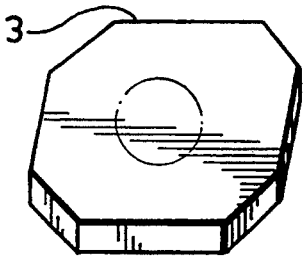
FIG.6 PRIOR ART
Figure 7:
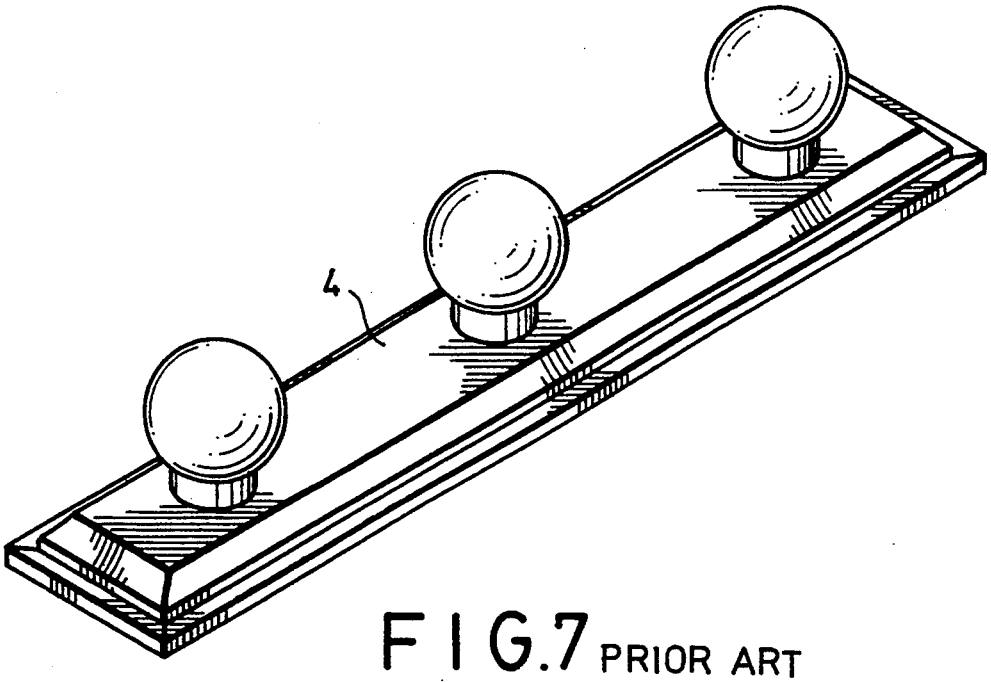
FIG.7 PRIOR ART
FIG. 7 illustrates another conventional illumination assembly which is formed by use of a press.
Figure 8:
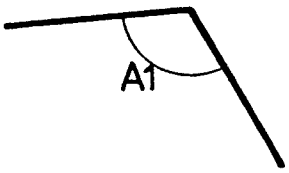
FIGS. 8 to 10 illustrate the possible angles between two interconnected plates of the illumination assembly.
Figure 9:
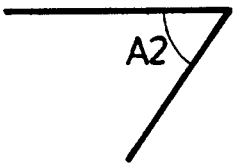
Figure 10:
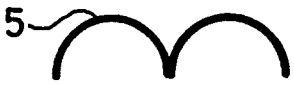
Figure 11:
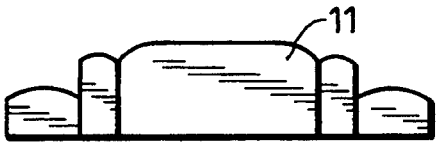
FIGS. 11 to 23 are elevational views of the modular angular/curvature illumination assemblies according to this invention, in which the light unit is removed from the channel units.
Figure 12:
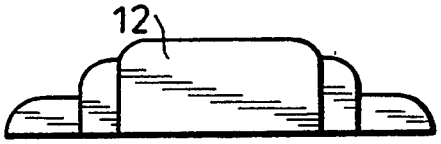
Figure 13:
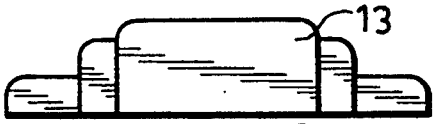
Figure 14:
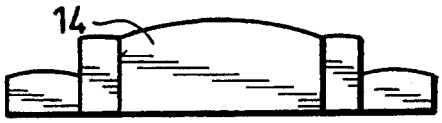
Figure 15:
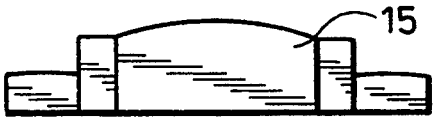
Figure 16:
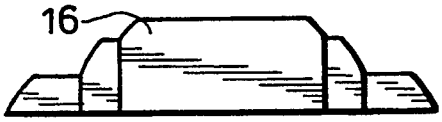
Figure 17:
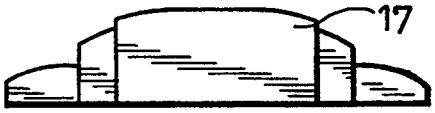
Figure 18:
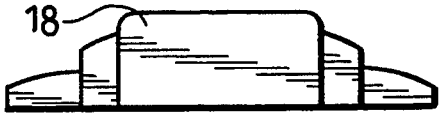
Figure 19:
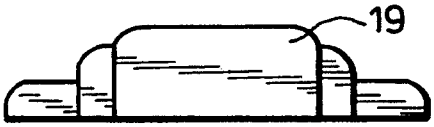
Figure 20:
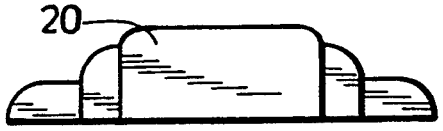
Figure 21:
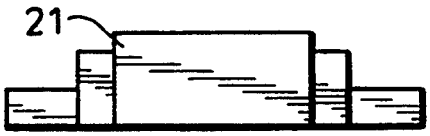
Figure 22:
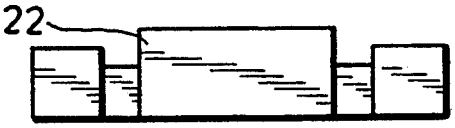
Figure 23:
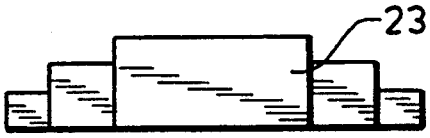
Figure 24:
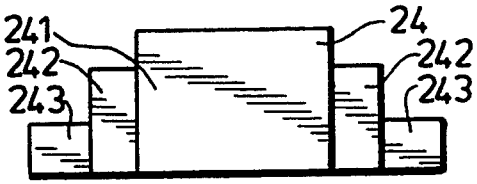
FIGS. 24 and 25 are elevational views showing another modular angular/curvature illumination assembly of this invention, in which the light unit is removed from the channel units.
Figure 25:
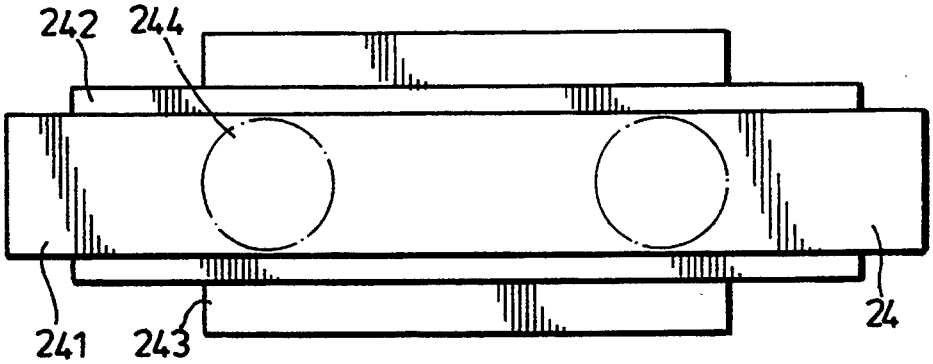

Each of FIGS. 11 to 24 illustrates a modular angular/curvature illumination assembly 11, 12, 13, 14, 15, 16, 17, 18, 19, 20, 21, 22, 23, 24 of this invention, which includes five metal channel units, four coupling units and a light unit mounted on one of the channel units in a known manner. Each of the channel units has a closed top end and an open bottom end. Each of the coupling units interconnects an adjacent pair of the channel units. For example, as best shown in FIGS. 24 and 25, the modular angular/curvature illumination assembly 24 consists of a first channel unit 241, two second channel units 242, two third channel units 243, four coupling units and two light units (shown in the phantom lines).

Figure 26:
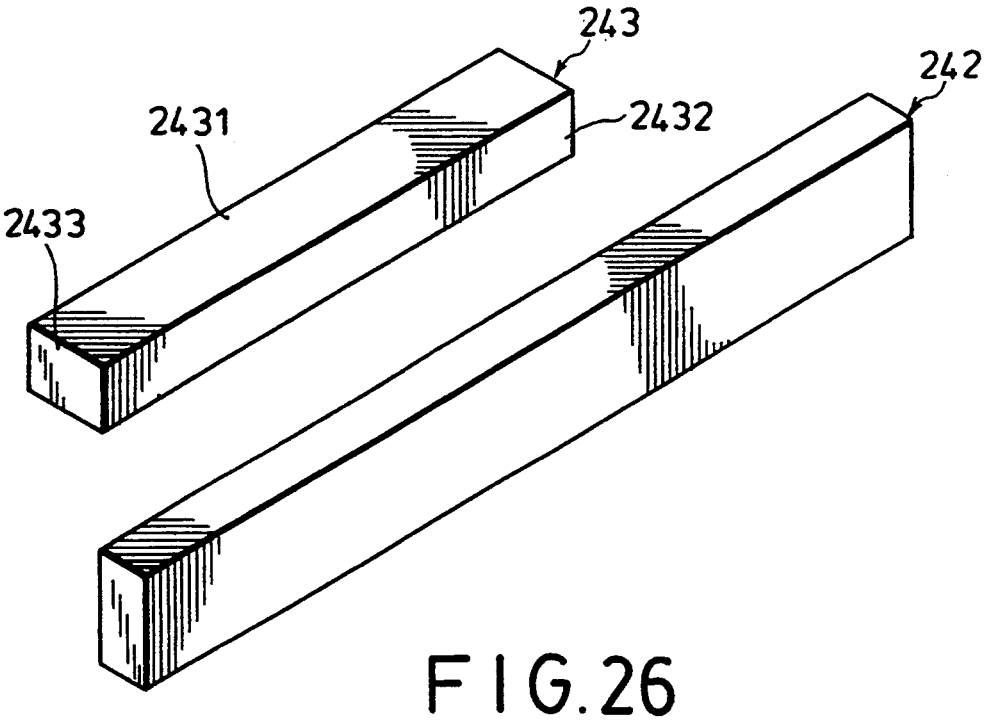
FIG. 26 is an exploded view showing two channel units of the modular angular/curvature illumination assembly of FIGS. 24 and 25.
Figure 27:
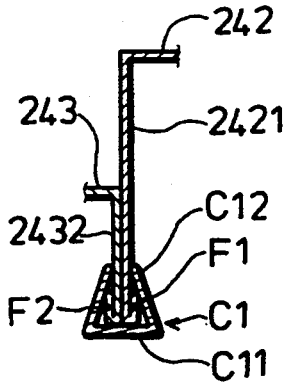
FIGS. 27 and 28 illustrate how the channel units of the modular angular/curvature illumination assembly are coupled together in accordance with this invention.

Referring to FIG. 26, each of the channel units 241, 242, 243 consists of a top wall, two side walls and two end walls. For example, each of the channel units 243 consists of a horizontal top wall 2431, two vertical side walls 2432 and two vertical end walls 2433. In this embodiment, as shown in FIG. 25, the light units are mounted on the top wall of the first channel unit 241 of the modular angular/curvature illumination assembly 24 in a known manner. Referring to FIG. 27, the coupling units may be generally U-shaped metal retaining clips C1 each of which has a horizontal base plate C11 and two inclined retaining plates C12 respectively and integrally formed with the opposite sides of the base plate C11 at the lower ends thereof. In this case, each of the side walls 2421, 2432 of the second and third channel units 242, 243 has a folded edge F1, F2 which is placed on the horizontal base plate C11 of the retaining clip C1 and under the upper end of the corresponding retaining plate C12 of the retaining clip C1. Accordingly, the folded edges F1, F2 of the second and third channel units 242, 243 are confined within the retaining clip C1 in such a manner that the folded edges F1, F2 abut against the retaining plates C12 of the retaining clip C1.

Figure 28:
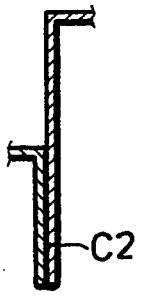

Referring to FIG. 28, alternatively, the side walls of any adjacent pair of the channel units may be coupled together by a nugget C2. The nugget C2 is formed via a spot welding process.

Figure 29:
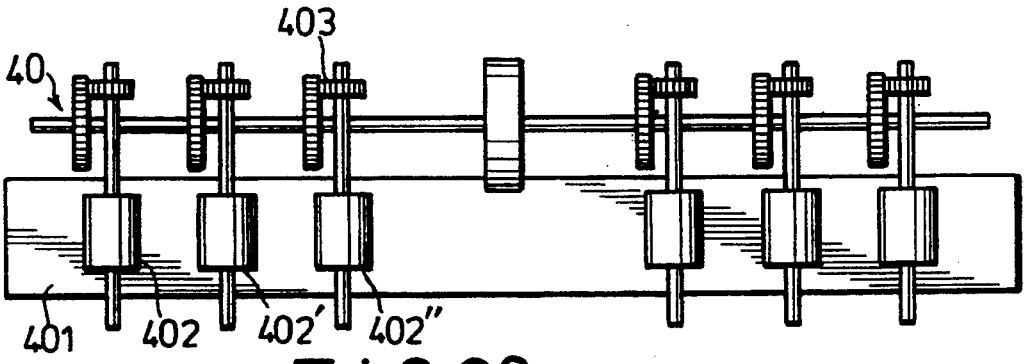
FIG. 29 illustrates a roll forming apparatus for forming the side walls of one of the channel units of the modular angular/curvature illumination assembly according to this invention.
Figure 30:
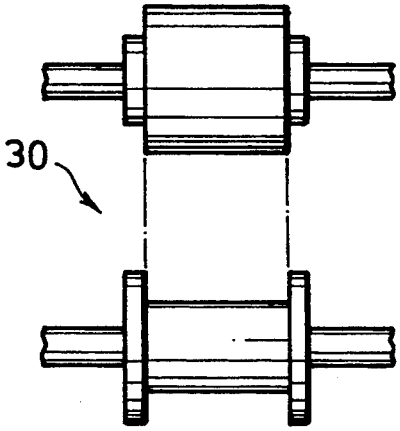
FIGS. 30 to 32 illustrate three examples of the roller die sets of the roll forming apparatus.
Figure 31:
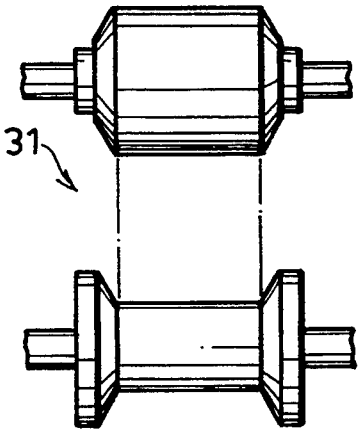
Figure 32:
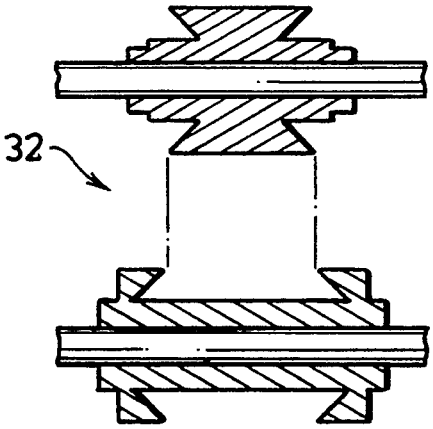

Referring to FIG. 29, the side walls of each of the channel units are gradually shaped by a step-by-step rolling process, during which a metal plate (not shown) is moved through a roll forming apparatus 40. The roll forming apparatus 40 includes a conveyer belt 401, a series of roller die sets 402, 402', 402'' disposed along the belt 401, and a gearing unit 403 driving the die sets 402 402', 402''. The roller die sets may be of various forms, e.g. the sets 30, 31 and 32 shown in FIG. 30, 31 and 32. The die sets 402, 402', 402'' apply varying amount of pressure on the plate so as to progressively bend or curve the plate into the predetermined shape. In this way, the angle between the top wall and the side wall of the channel unit can be less than 90 degrees. Two end walls may be welded to the top wall and the side wall of a channel unit for aesthetic purposes. For example, as shown in FIG. 27, two end walls 2433 are welded to the top wall 2431 and the side walls 2432 of the channel unit 243.

With this invention thus explained, it is apparent that numerous modifications and variations can be made without departing from the scope and spirit of this invention. It is therefore intended that this invention be limited only as indicated in the appended claims.

I claim:

1. A modular angular/curvature illumination assembly comprising:

a plurality of channel units each of which has two opposite side walls gradually shaped by a step-by-step rolling process, during which a metal plate is moved through a series of roller die sets for rolling treatment, the die sets applying varying amount of pressure on the plate;

a light unit mounted on one of said channel units; and a plurality of coupling units interconnecting the channel units in such a manner that the side walls of any adjacent pair of the channel units are coupled together by means of one of the coupling units.

2. A modular angular/curvature illumination assembly as claimed in claim 1, wherein each of the channel units has two folded edges, each of the coupling units including a generally U-shaped metal retaining clip which has a horizontal base plate and two inclined retaining plates, the inclined retaining plates being integrally formed with two opposite sides of the horizontal base plate, an adjacent pair of the folded edges of any adjacent pair of the channel units being confined within one of the retaining clips in such a manner that the folded edges respectively abut against the inclined retaining plates of the clips.

3. A modular angular/curvature illumination assembly as claimed in claim 1, wherein the side walls of each of the coupling units includes a nugget which joins an adjacent pair of the channel units together and which is formed in a spot welding process.

* * * * *